US005417438A

United States Patent [19]

Poff

[11] Patent Number: 5,417,438

[45] Date of Patent: May 23, 1995

[54] BLACK LIGHT VOLLEYBALL GAME AND APPARATUS

[76] Inventor: William D. Poff, 8129 Causeway Blvd. S., St. Petersburg, Fla. 33707

[21] Appl. No.: 253,931

[22] Filed: May 31, 1994

Related U.S. Application Data

[63] Continuation-in-part of Ser. No. 814,794, Dec. 31, 1991, abandoned.

[51] Int. Cl.[6] ..... A63B 71/02; F21K 7/00

[52] U.S. Cl. ..... 273/411; 273/DIG. 24; 362/431

[58] Field of Search ..... 273/411, DIG. 24; 362/431, 811

[56] References Cited

U.S. PATENT DOCUMENTS

| | | | |
|---|---|---|---|
| 2,869,690 | 1/1959 | Winters et al. | 273/431 |
| 3,156,418 | 11/1964 | Jarlonski et al. | 273/431 X |
| 3,918,719 | 11/1975 | Welch | 273/DIG. 24 X |
| 3,971,560 | 7/1976 | Panosh | 273/30 |
| 4,720,112 | 1/1988 | Stettner et al. | 273/411 |

*Primary Examiner*—William H. Grieb
*Attorney, Agent, or Firm*—John P. Halvonik

[57] ABSTRACT

The invention is a fluorescent volleyball game for playing volleyball after dark. The important features of the playing field are illuminated by using a fluorescent volleyball, fluorescent out of bounds markers, fluorescent net and support stand and a set of blacklights arranged around the field to illuminate the fluorescent colors to the diminished visibility of the non-essential features. Players may, optionally, wear fluorescent clothing.

4 Claims, 4 Drawing Sheets

BLACK LIGHT VOLLEYBALL GAME AND APPARATUS

This is a Continuation-in-Part of application Ser. No. 07/814,794, filed Dec. 31, 1991, now abandoned.

BACKGROUND

1. Field of the Invention

The invention relates to the field of outdoor games and, in particular, to a volleyball game and playing field that utilize fluorescent materials to make for a unique after dark game.

2. Prior Art

While there are fluorescent table tennis playing sets that are known, there are no volleyball games that use fluorescent materials or black lights.

SUMMARY OF THE INVENTION

The invention comprises a fluorescent volleyball game and set up for playing volleyball after dark. The game uses a set of black lights that are set up substantially around the playing field to illuminate the fluorescent materials that are used in the game. Items such as the net,the out of bounds lines, the volleyball and, possibly, the clothing of the players are coated with fluorescent material to enable them to be illuminated under the black lighting. The lights themselves should be on support stands preferably made of PVC and may be surrounded by wire mesh to prevent damage.

It is an object of the invention to provide an entertaining game that may be played after dark.

Another objective is to provide a volleyball playing field that glows in the dark so as to illuminate only those parts of the field, like the net and out of bounds markers, that are necessary for the game.

Other objectives of the game will become apparent once the invention is shown and described.

DESCRIPTION OF THE PREFERRED EMBODIMENT

Figure 3:
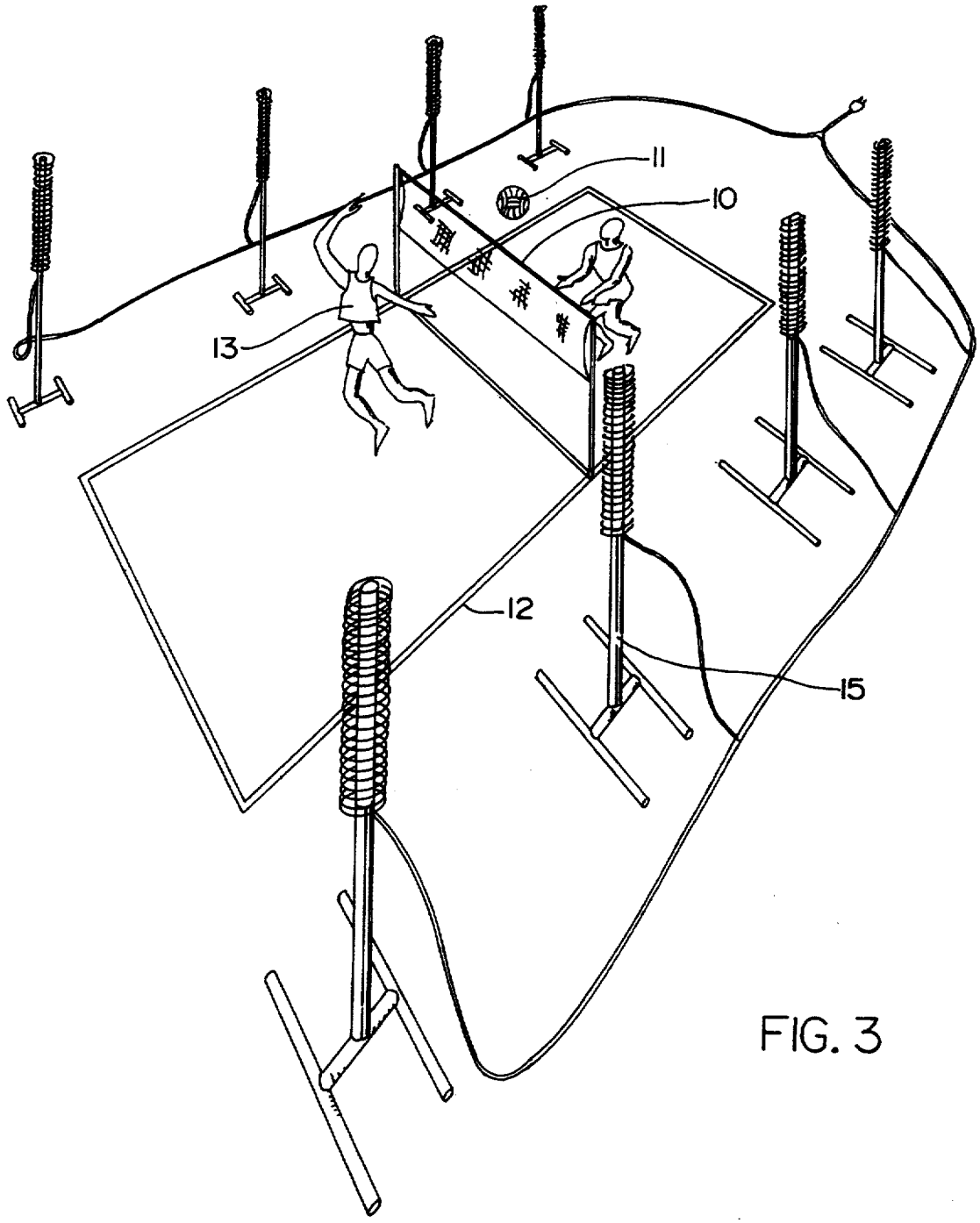
FIG. 3. Overall play and set up.

The volleyball game of the present application uses fluorescent materials to illuminate the important features of the playing field so that the game may be played at night, see FIG. 3. The important features being the net 10, sidelines 12, volleyball 11 and clothing 13 of the players. These features should be able to be seen by all the players so that the game can be competitive and challenging.

Figure 4:
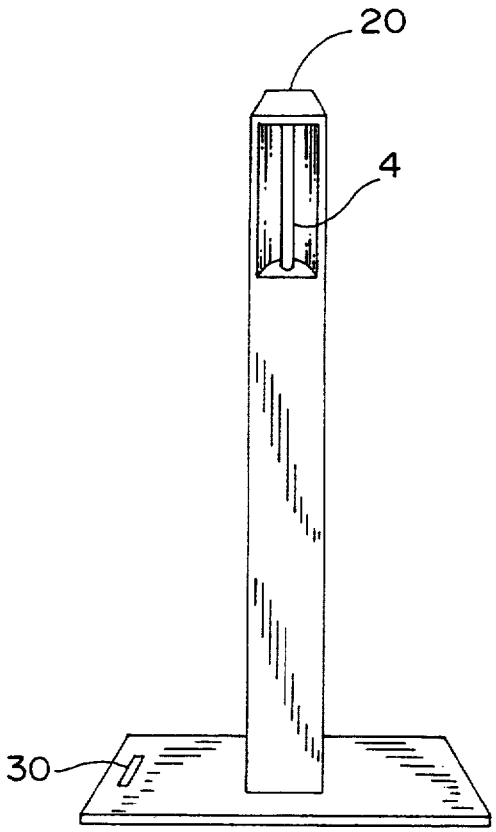
FIG. 4 Front view of light stand.
Figure 5:
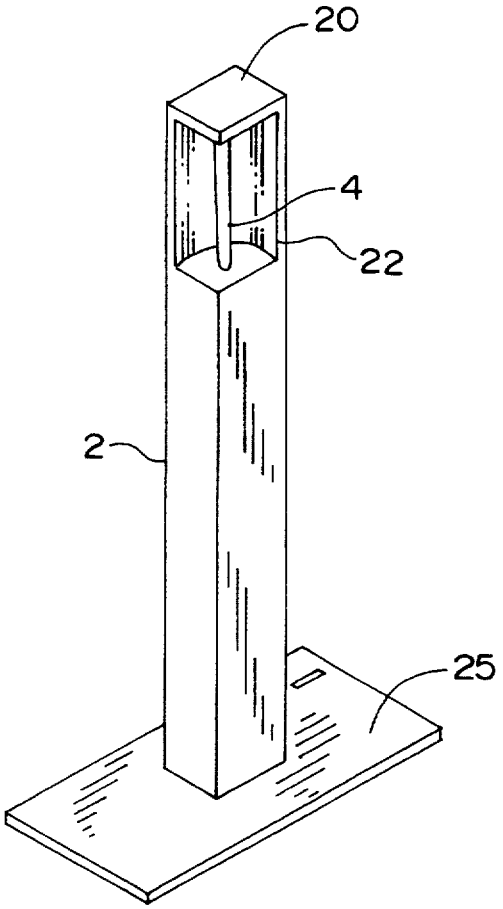
FIG. 5 Side view of light stand.

It is believed that volleyball games under black light are best played with lighting stands that are of special construction, see FIGS. 4 and 5. Each stand is designed to support an ultraviolet (UV) light emitting means 4 such as a so-called "black light." The stand has a base 25 and an upright portion 2. The base and/or the upright portion should have electrical connections in order to power the black light. The base may be equipped with a hand hold means 30 which may be simply an aperture in the base. The base should be of large enough construction to support the weight of the components of the stand on a sandy beach where the game is often played.

The light emitting means 4 rests inside the housing and should be near the top of the housing. The housing that sits atop the support stand surrounds a portion of the UV emitting means. There should be an aperture neaer the top of the housing for a protective lens 22 over the front of it where the light emates from. It is believed that the housing should cover only a portion of the light emitting means so that the UV light will be cast over a wide arc in order to illuminate both the playing field and the spectators.

To facilitate the lighting of the spectators the housing should only cover about 110° of the circumference of an imaginary circle drawn around the light as one looks down upon the light. This leaves an area of about 250° in the housing for the UV transmissive lens to occupy. If the housing is of square cross section, the lens will occupy almost about three of the sides and the housing only a little more than about one side.

The black light will then emanate in a wide arc from the lighting unit so that the playing field, as well as the spectator area, will be illuminated. It is believed that illuminating the specatator area in black light will offer amusement to the players and spectators as the spectators may be decorated with fluorescent materials as well as the players.

The cover or lens 22 should be made of an acrylic polymeric material that is transmissaable to UV light (UVT). It is believed that a cover or lens is important to keep the elements, such as rain, out of the electric parts in the stand in the event that the game is played in the rain. An example of one such material is that known as ACRYLITE OP-4 made by CYRO Industries of Mount Arlington, N.J. 07856. The use of such UV transmissive materials are useful because they are safe and also resistant to the outside weather elements e,g. rain, etc. which makes for a longer lasting unit and a volleyball game which may be played in inclement weather.

Other non-important features of the game that are not coated with fluorescent materials will likely not be able to be seen at night but would not adversely effect the performance of the players. The players themselves may, optionally, wear clothing with fluorescent materials, but the game may be played as well with players that cannot be seen. The combination of players wearing fluorescent and non-fluorescent clothing adds to the strategy of each team with some players being invisible.

The highlighted features of the ball, etc. appear to glow in the dark but are really fluorescent materials that are illuminated under black light, see FIG. 3. Black lights on support stands 15 are arranged about the sides of the playing field (see FIG. 2) away from the side lines to illuminate the ball, clothing, net, etc. The colors that may be used for the fluorescent material may vary, with pink or yellow being preferred. These colors appear to stand out the most at night.

The net may be of ordinary construction with an application of fluorescent paint or coating. It is preferred that the net be of cotton material, as this seems to absorb paint better than other materials. The out of bounds markers may be in the form of nylon tapes, plastic tapes, rope or other indicia. These are very easy to coat with fluorescent paint. Yellow paint is preferred for the out of bounds stripes as this can be easily seen.

Omitting the unnecessary elements of the game adds to the aesthetic effect for players and spectators alike. It is amusing, as well as fascinating, to watch the ball move over the net, seemingly under its own power. Alternately, when the players wear fluorescent shirts, their moves are apparent to teammates as well as spectators and the strategic aspects of these movements can be glimpsed.

Figure 2:
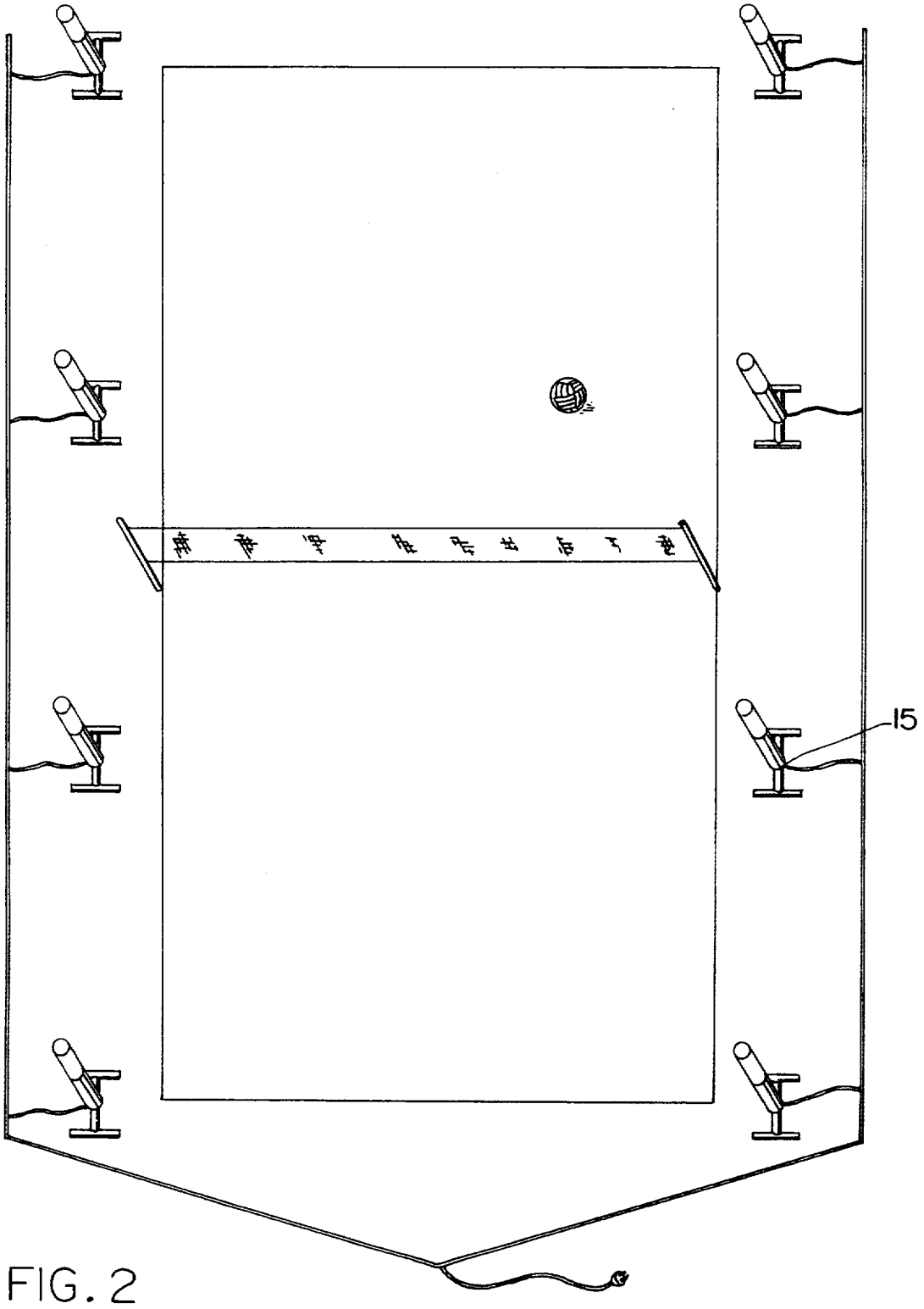
FIG. 2. Arrangement of lights.

The lights, see FIG. 2, should be arranged equally about the playing field with, preferably, 8 lights used and spaced apart about 20 feet with four lights on each side of the playing field. Obviously, the lights and support stands should not be actually in the field of play but rather a few feet off of the sidelines.

The black lights should be cylindrical in shape and about four feet high and mounted on top of polyvinyl chloride or light weight metal support stands. The support stands should be about 7 feet high.

Figure 1:
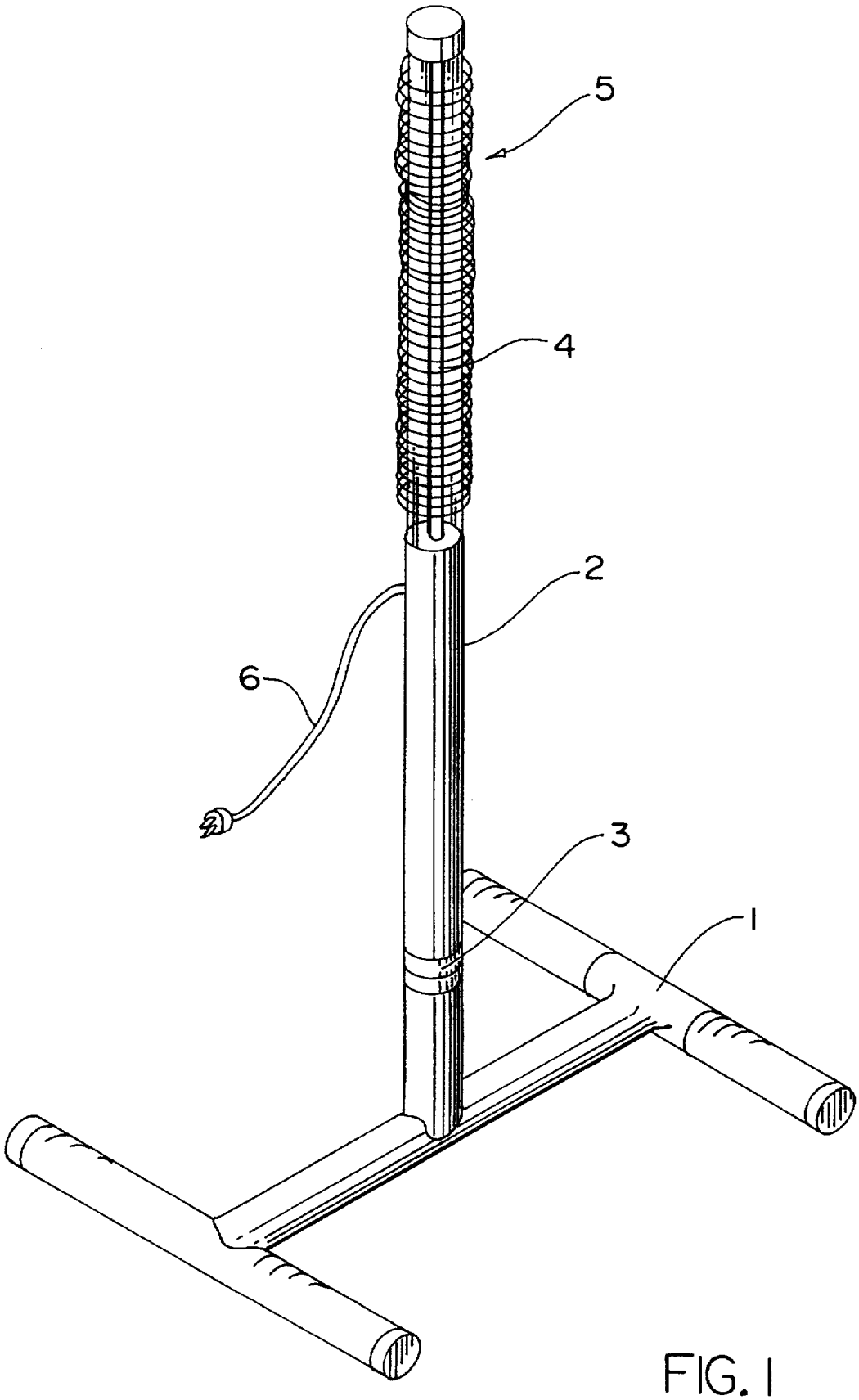
FIG. 1. Construction of light and stand.

The preferred embodiment of the light and stand is shown in FIG. 1. These stands would use a support base 1 of H-shaped construction made of three pieces of tubing (to form the H pattern) and a vertical supporting piece 2 attached to about the center of the base. The support may house sand or other material to weight the base for sturdy support. The vertical support tube should be threaded into a similar threaded portion 3 of the H shaped base, this allows the support stand to be broken down for ready transport. PVC material is not the only material that could be used for the tubing, wood, aluminum, plastic, etc. all readily coming to mind.

The cylindrical black light 4 should be placed atop the vertical support. A protective wire mesh 5 may be arranged around each of the black lights to prevent damage from the ball or otherwise. The lights may be battery powered or conected to power sources through electric cords 6. The PVC pipe should be of tubular construction to allow the supporting stands to be quickly set up in place.

It is preferred that black light be used as this provides the necessary illumination of the fluorescent material without illuminating the non-fluorescent materials, e.g.: the playing surface, etc. The volleyball game may be played under the ordinary rules of volleyball or such variation as the players themselves may desire.

I claim:

1. A blacklight stand comprising: a support base and a support stand connected to said base in perpendicular relation, a UV light emitting means in connection with said stand, a housing connected to said support stand and around said UV emitting means, said housing having an aperture extending in a circumferential fashion around said light emitting means, a lens in connection with said aperture, said lens made of a material transmissive to UV light.

2. The apparatus of claim 1 wherein said housing extends about 110° around the circumference of said UV light emitting means and said aperture extends about 250° around the circumference of said UV light emitting means.

3. The apparatus of claim 2 wherein said material transmissive to UV light is an acrylic polymer material.

4. A method of illuminating a playing field with a black light stand comprising: illuminating said playing field with light from a black light stand, said stand comprising: a support base and a support stand connected to said base in perpendicular relation, a UV light emitting means in connection with said stand, a housing connected to said support stand and around said UV emitting means, said housing having an aperture extending in a circumferential fashion around said light emitting means, a lens in connection with said aperture, said lens made of a material transmissive to UV light.

* * * * *